US008999112B2

(12) United States Patent
Faucher et al.

(10) Patent No.: US 8,999,112 B2
(45) Date of Patent: Apr. 7, 2015

(54) PROCESS FOR MANUFACTURING PAPER AND BOARD HAVING IMPROVED RETENTION AND DRAINAGE PROPERTIES

(71) Applicants: Gatien Faucher, Saint Etienne (FR); Rene Hund, Villars (FR)

(72) Inventors: Gatien Faucher, Saint Etienne (FR); Rene Hund, Villars (FR)

(73) Assignee: S.P.C.M. SA (FR)

( * ) Notice: Subject to any disclaimer, the term of this patent is extended or adjusted under 35 U.S.C. 154(b) by 0 days.

(21) Appl. No.: 13/753,631

(22) Filed: Jan. 30, 2013

(65) Prior Publication Data

US 2013/0139986 A1 Jun. 6, 2013

Related U.S. Application Data

(63) Continuation of application No. PCT/FR2011/051801, filed on Jul. 26, 2011.

(30) Foreign Application Priority Data

Aug. 2, 2010 (FR) ..... 10 56367

(51) Int. Cl.

| | |
|---|---|
| ***D21H 21/10*** | (2006.01) |
| ***D21H 17/42*** | (2006.01) |
| ***D21H 17/43*** | (2006.01) |
| ***D21H 17/45*** | (2006.01) |
| ***D21H 17/68*** | (2006.01) |
| ***D21H 23/04*** | (2006.01) |
| ***D21H 17/00*** | (2006.01) |
| ***D21H 17/37*** | (2006.01) |

(52) U.S. Cl.

CPC ..... *D21H 17/72* (2013.01); *D21H 17/375* (2013.01); *D21H 17/42* (2013.01); *D21H 17/45* (2013.01); *D21H 21/10* (2013.01)

(58) Field of Classification Search

USPC ..... 162/164.1, 164.5–164.7, 158, 162/168.1–168.3, 168.7, 181.1, 162/181.5–181.8, 183, 185

See application file for complete search history.

(56) References Cited

U.S. PATENT DOCUMENTS

| | | | | |
|---|---|---|---|---|
| 3,052,595 A | | 9/1962 | Pye | |
| 4,388,150 A | | 6/1983 | Sunden et al. | |
| 4,753,710 A | | 6/1988 | Langley et al. | |
| 5,167,766 A | * | 12/1992 | Honig et al. | 162/164.1 |
| 5,501,774 A | * | 3/1996 | Burke | 162/164.1 |
| 5,530,069 A | * | 6/1996 | Neff et al. | 525/329.4 |
| 6,103,065 A | * | 8/2000 | Humphreys et al. | 162/181.8 |
| 2006/0142431 A1 | * | 6/2006 | Sutman et al. | 524/13 |
| 2008/0128102 A1 | * | 6/2008 | Polverari et al. | 162/168.3 |
| 2008/0196851 A1 | * | 8/2008 | Hund et al. | 162/164.6 |
| 2009/0050282 A1 | * | 2/2009 | Faucher et al. | 162/164.5 |
| 2010/0186914 A1 | * | 7/2010 | Jehn-Rendu et al. | 162/164.6 |
| 2010/0326614 A1 | * | 12/2010 | Hund et al. | 162/164.6 |

FOREIGN PATENT DOCUMENTS

| | | | |
|---|---|---|---|
| EP | 1328161 B1 | | 7/2003 |
| WO | 0187080 A2 | | 11/2001 |
| WO | WO 03/050152 A1 | * | 6/2003 |
| WO | 2006075115 A2 | | 6/2006 |
| WO | 2008107620 A2 | | 9/2008 |
| WO | WO 2008/107620 A2 | * | 9/2008 |
| WO | 2009013423 A2 | | 1/2009 |
| WO | 2010061082 A1 | | 6/2010 |

OTHER PUBLICATIONS

"Polyvinyl Compounds, Others", Ullmann's Encyclopedia of Industrial Chemistry, vol. 29, pp. 605-621, John Wiley & Sons, Inc., [online], 2000, [retrieved on Jan. 6, 2014], Retrieved from the Internet: <URL:http://onlinelibrary.wiley.com/doi/10.1002/14356007.a21_743/pdf>.*

Waech, "Improving Filler Retention by Adding Filler After Retention Aid Addition"; Tappi Journal, Mar. 1983, pp. 137-139.

International Preliminary Report on Patentability (French Language) Application No. PCT/FR2011/051801 Completed: Jul. 26, 2012 12 pages.

International Search Report Application No. PCT/FR2011/051801 Completed: Oct. 11, 2011; Mailing Date: Oct. 20, 2011 2 pages.

Unbehend, "Mechanisms of "Soft" and "Hard" Floc Formation in Dynamic Retention Measurement"; Tappi Journal, vol. 59, N 10, Oct. 1976, pp. 74-77.

Britt, "Mechanisms of Retention During Paper Formation"; Tappi Journal; vol. 56, Oct. 1973, p. 46-50.

Luner, "The Effect of Stock Preconditioning on Filler Retention and Paper Properties"; 1984 Papermakers Conference, Tappi Journal Apr. 1984, pp. 95-99.

* cited by examiner

*Primary Examiner* — Dennis Cordray

(74) *Attorney, Agent, or Firm* — St. Onge Steward Johnston & Reens LLC

(57) ABSTRACT

A method for manufacturing a sheet of paper and/or board having improved retention and drainage properties is provided, according to which, before the formation of the sheet and/or board, at least two retention aids are added to the fibrous suspension. These two retention aids are a main retention aid corresponding to a (co)polymer having a cationic charge density above 2 meq/g, obtained by the Hofmann degradation reaction, and a secondary retention aid corresponding to a water-soluble or water-swellable polymer having an anionic charge density above 0.1 meq/g. The main retention aid is introduced into the fibrous suspension in a proportion of 100 to 800 g/t of dry pulp, and the secondary retention aid is introduced into the fibrous suspension in a proportion of 50 to 800 g/t of dry pulp and has an intrinsic viscosity IV above 3 dl/g.

15 Claims, No Drawings

PROCESS FOR MANUFACTURING PAPER AND BOARD HAVING IMPROVED RETENTION AND DRAINAGE PROPERTIES

FIELD OF THE INVENTION

The invention relates to a method for manufacturing paper and board having improved retention and drainage properties. More precisely, the invention relates to a manufacturing method using at least two retention and drainage aids, a main aid and a secondary aid, respectively. It also relates to paper and board obtained by the said method.

BACKGROUND OF THE INVENTION

The use of retention systems is well known in papermaking processes. They have the function of improving the retention (that is to say the quantity of filler in the paper) and the drainage (that is to say, the dewatering rate) during the manufacture of the sheet.

Patent EP 1 328 161 describes a system for improving retention and drainage during the manufacture of paper or board using three retention aids. The first is a cationic flocculant having an intrinsic viscosity IV above 4 dl/g, the second is a siliceous material and the third a water-soluble anionic polymer having an IV of 4 dl/g or more.

All the retention and drainage systems known in the prior art are characterized by the fact that as the main retention aid, they use water-soluble polymers having high molecular weight, above 1 million g/mol, generally above 3 million, called flocculants. They are generally cationic and, owing to their high molecular weight, have the property of occurring in the form of an emulsion (reverse), microemulsion, powder or dispersion.

The Hofmann degradation reaction on a base (co)polymer is a known reaction for converting an amide to a primary amine having one less carbon atom.

Hofmann degradation products are well known for their use as dry strength agents. In practice, the molecular weight of the degradation product is generally less than 1 million g/mol, hence much lower than the molecular weight of the cationic polymers used as drainage and retention aids (above 2 million g/mol). When used as strength agents in papermaking processes, they are combined with low molecular weight anionic resins.

Such a system is, for example, the one described in document WO2006/075115 from the Applicant. This relates to a cationic polymer obtained by Hofmann degradation reaction, produced in a concentration above 3.5% combined with an anionic resin of which the highest viscosity is 9000 cps (15% solution), which corresponds to a maximum IV of about 2.0 dl/g. A similar system is also described in document WO2008/107620, also from the Applicant, which is distinguished from the former in that the base copolymer on which the degradation is carried out is branched, and in that the degradation is carried out in the presence of calcium hypochlorite. In this document, the maximum viscosity described of the anionic resin is 2500 cps, which corresponds to a maximum IV of 1.6 dl/g. Application WO2009/013423, also from the Applicant, is distinguished from the preceding documents in that the polymer obtained by the Hofmann degradation reaction is branched after the said reaction. As previously, the IV of the anionic resin used does not exceed 1.6 dl/g.

It is essential in the invention to clearly distinguish the retention and drainage properties on the one hand, and the dry strength properties on the other hand.

Retention properties mean the ability to retain the suspended matter in the paper pulp (fibres, fines, fillers (calcium carbonate, titanium oxide), etc.) on the preparation web, hence in the fibrous mat which constitutes the final sheet. The action mechanism of the retention aids is based on the flocculation of this suspended matter in the water. This ensures that the flocs formed are more easily retained on the preparation web.

As to the drainage properties, they represent the ability of the fibrous mat to remove or drain the maximum of water so that the sheet dries as rapidly as possible.

Since these two properties (retention and drainage) are intimately linked, as one depends on the other, the aim is to find the best compromise between retention and drainage. In general, the person skilled in the art refers to a retention and drainage aid, because the same types of product serve to improve these two properties.

They are generally slightly cationic high molecular weight polymers (at least 1 million g/mol). These polymers are generally introduced in a proportion of 50 to 800 g/t of dry polymer with respect to the dry paper.

The points of introduction of these aids in the papermaking process are generally located in the short circuit, that is to say, after the fan pump, and hence in thin stock, of which the concentration is generally lower than 1% by weight of dry matter, usually between 0.1 and 0.7%.

Contrary to the retention and drainage properties, the dry strength represents the ability of the sheet to withstand the mechanical stresses and damage such as perforation, tearing, tension, delamination and various forms of compression. These relate to the final properties of the sheet.

Dry strength resins are generally medium molecular weight polymers (10,000 to 1,000,000 g/mol), and the usual dosages applied are from 1.5 to 2 kg/t (dry polymer with respect to dry paper), that is to say, 5 to 10 times higher than the dosages applied to retention and drainage, even though a wide range between 100 and 20,000 g/t is disclosed in application WO2009/013423.

Furthermore, the points of introduction of these dry strength resins, in particular for the cationic polymer, are generally located in thick stock, of which the dry matter concentration is generally above 1% and usually above 2%, hence before the fan pump, and therefore the dilution with the white water.

The Applicant further indicates that the examples in application WO2009/13423 mention pulp concentrations of about 0.3 to 0.5%, which correspond to the values required to perform standard laboratory tests, but which do not correspond to the pulp concentrations in industrial processes in which dry strength agents are used, and which are generally above 2% of dry matter.

The polymers providing dry strength are joined to the fibres by a hydrogen and/or ionic bond so that, once the sheet is dried, the mechanical strength of the paper is improved.

It therefore goes without saying that, on the one hand, good retention and drainage properties are recommended to optimise the manufacture of the paper and hence the productivity of the paper machine, and on the other hand, in a totally different manner, good dry strength properties will have the effect of improving the mechanical properties (and hence the quality) of the sheet.

In the rest of the description and in the claims, all the polymer dosages expressed in g/t are given as weight of active polymer per tonne of dry pulp.

The dry strength of the paper is, by definition, the strength of the normally dried sheet. The values of the burst and tensile strength conventionally provide a measure of the dry strength of the paper.

A side effect of the application of these dry strength systems in high dosages, is accompanied, subsidiarily, by an improvement in retention, but at prohibitive costs, which cannot possibly justify their use for this purpose alone.

It therefore appears from the above discussion that it was known on the filing date of the present application how to combine, in order to improve the dry strength in the process for manufacturing paper or board, a low molecular weight cationic Hofmann degradation product with an anionic resin also having a low molecular weight, the two agents being introduced during the process in doses of about 1.5 to 2 kg/t.

Despite the progress achieved in recent years, the paper industry still faces the following problems in retention and drainage systems:

- difficulty and cost of applying cationic flocculants as main retention aid. Their high molecular weight entails their use in forms demanding preparation units (emulsion reversal, powder dissolution), costly in manpower, equipment and maintenance. The necessary filtration steps are also the cause of many line shutdowns and added costs;
- a problem of filtration of insoluble particles, and even clogging of the filters, can cause major defects in the paper machine: breakage, defects in the paper such as patches, holes, etc.;
- the negative impact on the formation of the sheet, during the use of excessively high molecular weight polymers or high molecular weight polymers in high dosages;
- the use of high molecular weight flocculant necessitated by increasingly high machine speeds hence increasingly higher sheet shear and filler content.

SUMMARY OF THE INVENTION

The Applicant has found quite surprisingly that the use of a similar system to the one described in the abovementioned documents, in which:

- the low molecular weight anionic resin is replaced by a high molecular weight anionic polymer,
- the dosage of each of the two polymers is adjusted from 1500 to 2000 g/t to 100 to 800 g/t for the cationic polymer and from 50 to 800 g/t for the anionic polymer, served to improve the retention and drainage in a process for manufacturing paper or board.

The invention thus has the advantage of using a low molecular weight cationic polymer without requiring shear steps which are difficult to control, and without heavy implementation equipment (simple in-line or tangential dilution instead of a complex preparation unit) to improve retention and drainage.

In other words, the invention relates to a method for manufacturing a sheet of paper and/or board having improved retention and drainage properties, according to which, before the formation of the said sheet and/or board, at least two retention aids are added to the fibrous suspension, at one or more injection points, respectively:

- a main retention aid corresponding to a (co)polymer having a cationic charge density above 2 meq/g, obtained by the Hofmann degradation reaction, in aqueous solution, in the presence of an alkaline-earth and/or alkali hydroxide and of an alkaline-earth and/or alkali hypohalide, on a base (co)polymer comprising at least one nonionic monomer selected from the group comprising acrylamide (and/or methacrylamide), N,N dimethylacrylamide,
- a secondary retention aid corresponding to a water-soluble or water-swellable polymer having an anionic charge density above 0.1 meq/g.

The method is characterized in that:

- the main retention aid is introduced into the fibrous suspension in a proportion of 100 to 800 g/t of dry pulp,
- the secondary retention aid is introduced into the fibrous suspension in a proportion of 50 to 800 g/t of dry pulp and has an intrinsic viscosity IV above 3 dl/g.

In a preferred embodiment, the main retention aid is introduced into the fibrous suspension in a proportion of 200 to 500 g/t of dry pulp.

Similarly, the secondary retention aid is introduced into the fibrous suspension in a proportion of 80 to 500 g/t, preferably between 100 and 350 g/t.

Furthermore, the use of low molecular weight product serves to install the retention system, optionally, without intermediate shear, or even after the final shear point (centriscreen), which has the effect of limiting the dosages of each ingredient while maintaining high performance.

DETAILED DESCRIPTION OF THE INVENTION

In other words, in a particular embodiment, the introduction of the retention aids is separated, as required, by a shear step.

This system with at least 2 components can be used successfully for manufacturing packaging paper and board, coating support paper, any type of paper, board or similar demanding improved retention and drainage properties, with increased formation with dosages of main retention aid ranging from 100 to 800 g/t of dry pulp, which is impossible for the usual retention aids of the high molecular weight cationic polyacrylamide type.

As already stated, according to the present invention, it has been discovered surprisingly and quite unexpectedly that in a retention-drainage system having at least two components, the cationic flocculant conventionally used could be replaced by a cationic (co)polymer obtained by Hofmann degradation reaction on an acrylamide (co)polymer, when used in combination with a high molecular weight water-soluble or water-swellable anionic polymer.

The inventive method uses at least one main retention aid which is a (co)polymer obtained by Hofmann degradation reaction on an acrylamide (and/or methacrylamide) (co)polymer, and/or N,N dimethylacrylamide, the said (co)polymer being characterized in that:

- the polymer is in the form of an aqueous solution;
- its molecular weight is lower than 1 million g/mol, preferably lower than 500,000 g/mol, more preferably lower than 100,000 g/mol;
- its cationicity is higher than 2 meq/g, preferably higher than 4 meq/g;
- it is introduced in dosages between 100 and 800 g of active polymer per tonne of dry pulp (g/t), preferably between 200 and 500 g/t.

The inventive method uses at least one second retention aid which is a water-soluble or water-swellable polymer having an anionic charge density above 0.1 meq/g characterized in that:

- it has an intrinsic viscosity IV above 3 dl/g,
- it is introduced in dosages between 50 and 800 g of active polymer per tonne of dry pulp (g/t), preferably between 80 and 500 g/t, more preferably between 100 and 350 g/t.

IV means the intrinsic viscosity expressed in dl/g.

The person skilled in the art was deterred from using, as main retention aid, a very low molecular weight compound based on acrylamide, which is particularly unsuitable for flocculating fibres, in particular when the process is applied in closed circuits, when it uses recycled fibres and when it is carried out at high paper machine speeds. One of the merits of the invention is to have developed a papermaking process which uses, as main retention aid, an aqueous solution requiring no restrictive preparation step. The cationic (co)polymer of the invention can easily be introduced into the system with simply a tangential or in-line dilution, allowing its instantaneous incorporation in the wet part of the machine.

According to the invention, a tertiary retention aid can also be added, either between the two abovementioned aids, or after the secondary aid. This includes derivatives of silica such as, for example, silica particles, including bentonites, montmorillonites or aluminosilicate or borosilicate derivatives, zeolites, kaolinites, colloidal silicas, modified or not.

The additions of main retention aid and secondary and tertiary aids are separated or not by a shear step, for example at the fan pump. Reference should be made in this area to the description of U.S. Pat. No. 4,753,710, and to a very vast prior art dealing with the injection point of the retention aid with regard to the shear steps existing on the machine, in particular U.S. Pat. No. 3,052,595, Unbehend, TAPPI Vol. 59, N 10, October 1976, Luner, 1984 Papermakers Conference ou Tappi, April 1984, pp 95-99, Sharpe, Merck and Co Inc, Rahway, N.J., USA, around 1980, Chapter 5 polyelectrolyte retention aids, Brin, Tappi Vol. 56, October 1973, p 46 ff. and Waech, Tappi, March 1983, pp 137, or even U.S. Pat. No. 4,388,150.

The inventive method serves to obtain a significantly improved retention. The drainage properties are also improved, representing an additional feature of this improvement, without deteriorating the sheet formation quality, and even in main retention aid doses ranging from 100 to 800 g of active matter per tonne of dry pulp.

This method serves to achieve a level of performance hitherto unequalled in papermaking applications for the total and filler retention, and drainage, including for paper pulps containing high contents of recycled fibres.

A/ Main Retention Aid:

The main retention aid is selected from cationic or amphoteric copolymers characterized in that they are obtained by the Hofmann degradation reaction on an acrylamide base (base polymer) precursor in the presence of an alkali and/or alkaline-earth hydroxide (advantageously sodium hydroxide), and an alkali and/or alkaline-earth hypochlorite (advantageously sodium hypochlorite).

The base copolymer is a synthetic water-soluble polymer based on acrylamide containing at least one nonionic monomer such as, for example, acrylamide, and optionally other monomers such as, for example, one or more monomers, either cationic, such as, for example dimethyldiallylammonium chloride (DADMAC), or anionic such as, for example, acrylic acid, or hydrophobic.

More precisely, the "base" copolymer used contains:

- at least one nonionic monomer selected from the group comprising acrylamide (and/or methacrylamide), N,N dimethylacrylamide,
- and optionally at least:
  - one unsaturated cationic ethylene monomer preferably selected from the group comprising dialkylaminoalkyl(meth)acrylamide, diallylamine, methyldiallylamine monomers and their quaternary ammonium or acid salts. Mention can be made in particular of dimethyldiallylammonium chloride (DADMAC), acrylamidopropyltrimethylammonium chloride (APTAC) and/or methacrylamidopropyltrimethylammonium chloride (MAPTAC),
  - and/or a nonionic monomer preferably selected from the group comprising N-vinyl acetamide, N-vinyl formamide, N-vinylpyrrolidone and/or vinyl acetate,
  - and/or an acidic or anhydride anionic monomer selected from the group comprising (meth)acrylic acid, acrylamidomethylpropyl sulphonic acid, itaconic acid, maleic anhydride, maleic acid, methallyl sulphonic acid, vinylsulphonic acid and salts thereof.

It is important to note that, in combination with these monomers, it is also possible to use water-insoluble monomers such acrylic, allyl or vinyl monomers comprising a hydrophobic group. During their use, these monomers are employed in very small quantities, lower than 10 mol %, preferably lower than 5 mol %, or even lower than 1%, and they are preferably selected from the group comprising derivatives of acrylamide such as N-alkylacrylamide, for example, N-tert-butylacrylamide, octylacrylamide and N,N-dialkylacrylamides such as N,N-dihexylacrylamide etc. derivatives of acrylic acid such as alkyl acrylates and methacrylates, etc.

According to a preferred feature of the invention, the base copolymer can be branched.

The branching can preferably be carried out during (or optionally after) the polymerisation of the "base" copolymer, in the presence of a polyfunctional branching agent and optionally a transfer agent. A non-limiting list of branching agents is given below: methylene bisacrylamide (MBA), ethylene glycol di-acrylate, polyethylene glycol dimethacrylate, diacrylamide, cyanomethylacrylate, vinyloxyethylacrylate or methacrylate, triallylamine, formaldehyde, glyoxal, compounds of the glycidylether type such as ethyleneglycol diglycidylether, or epoxides or any other means well known to a person skilled in the art allowing cross-linkage.

In practice, the branching agent is advantageously introduced in a proportion of five to fifty thousand (5 to 50000) parts per million by weight of active matter, preferably 5 to 10000, advantageously 5 to 5000. Advantageously, the branching agent is methylene bis acrylamide (MBA).

The copolymer serving as a basis for the Hofmann degradation reaction does not require the development of a particular polymerisation process. The main polymerisation techniques, well known to a person skilled in the art and feasible are: precipitation polymerisation, emulsion polymerisation (aqueous or reverse) followed or not by a distillation and/or spray drying step, and suspension polymerisation or solution polymerisation, these two techniques being preferred.

This base is characterized in that it has a molecular weight that is advantageously higher than 5000 and without any maximum limit, the only limiting factor being, for obvious limitations in implementation, the viscosity of the polymeric solution which is a function of the (co)polymer concentration and its molecular weight.

It is also possible to add to the base copolymer solution, before or during the Hofmann degradation reaction, a number of additives which are capable of reacting with the polymer isocyanate functions generated during the degradation. In general, these are molecules carrying nucleophilic chemical functions such as hydroxyl, amine functions, etc. For example, the additives in question can therefore be of the following families: alcohols, polyols (e.g.: starch), polyamines, polyethylene imines, etc.

The Hofmann reaction requires conversion of the amide functions to amine functions involving 2 main factors (expressed in molar ratios):

Alpha=(alkali and/or alkaline-earth hypochlorite/(meth) acrylamide)

Beta=(alkali and/or alkaline-earth hydroxide/alkali and/or alkaline-earth hypochlorite)

Using a "base" copolymer solution previously described having a concentration of 5 to 40% by weight, preferably between 10 and 25%, the molar quantity of total (meth) acrylamide function is determined. The desired Alpha degradation level is then selected (which corresponds to the desired degree of amine function), which serves to determine the dry quantity of alkali and/or alkaline-earth hypohalide and then the beta coefficient, which serves to determine the dry quantity of alkali and/or alkaline-earth hydroxide.

A solution of alkali and/or alkaline-earth hypohalide and hydroxide is then prepared using the alpha and beta ratios. According to the invention, the reagents preferably used are sodium hypochlorite (Javel water) and caustic soda (sodium hydroxide).

In practice, the Hofmann degradation product is obtained by reaction of an alkaline-earth hydroxide and an alkaline-earth hypohalide with a hydroxide/hypohalide molar ratio of between 2 and 6, preferably between 2 and 5.

According to another feature, the Hofmann degradation product is produced in a concentration above 4% by weight, preferably above 7%, advantageously above 8% and advantageously has a viscosity above 30 cps (in a concentration of 9%, at 25° C., Brookfield LVI, 60 rpm), preferably above 40 cps.

Advantageously, the quantity of the main retention aid introduced into the suspension is between 100 and 800 grams of active polymer per tonne of dry pulp (g/t). Preferably, the quantity of main retention aid introduced is between 200 g/t and 500 g/t.

The injection or introduction of the main retention aid according to the invention is carried out before an optional shear step, in the more or less dilute paper pulp according to the practice of the person skilled in the art, and generally in the thin stock. In other words, the main retention aid is advantageously injected into the thin stock in a concentration not exceeding 2%.

B/ Secondary Retention Aid

According to the invention, the secondary retention aid is selected from all types of water-soluble or water-swellable organic polymers having an anionic charge density above 0.1 meq/g. These polymers have an intrinsic viscosity above 3 dl/g.

In practice, the polymer used consists of:

a/ at least one anionic monomer having a carboxyl function (e.g.: acrylic acid, methacrylic acid, and salts thereof, etc.), or possessing a sulphonic acid function (e.g.: 2-acrylamido-2-methylpropane sulphonic acid (AMPS), vinyl sulphonic acid, methallyl sulphonic acid and salts thereof, etc.), or possessing phosphonic functions (e.g.: vinyl phosphonic acid), Optionally combined with:

b/ one or more nonionic monomers selected for example from the following list: acrylamide, methacrylamide, N,N dimethylacrylamide, N-vinyl pyrrolidone, N-vinyl acetamide, N-vinyl formamide, vinylacetate, acrylate esters, allyl alcohol, c/ one or more cationic monomers selected in particular and in a non-limiting manner from the group comprising quaternized or salified dimethylaminoethyl acrylate (ADAME) and/or quaternized or salified dimethylaminoethyl methacrylate (MADAME), dimethyldiallylammonium chloride (DADMAC), acrylamido propyltrimethyl ammonium chloride (APTAC) and/or methacrylamido propyltrimethyl ammonium chloride (MAPTAC), d/ one or more hydrophobic monomers such as acrylic, allyl or vinyl monomers comprising a hydrophobic group. They are preferably selected from the group comprising derivatives of acrylamide such as N-alkylacrylamide for example N-tertbutylacrylamide, octylacrylamide and N,N-dialkylacrylamides such as N,N-dihexylacrylamide etc., derivatives of acrylic acid such as alkyl acrylates and methacrylates, e/ one or more branching/cross-linking agents preferably selected from the group comprising methylene bisacrylamide (MBA), ethylene glycol di-acrylate, polyethylene glycol dimethacrylate, diacrylamide, cyanomethylacrylate, vinyloxyethylacrylate or methacrylate, triallylamine, formaldehyde, glyoxal, compounds of the glycidylether type such as ethyleneglycol diglycidylether, or epoxides, f/ one or more transfer agents such as, for example, isopropyl alcohol, sodium hypophosphite, mercaptoethanol.

According to the invention, the water-soluble polymers used do not require the development of a particular polymerisation process. They can be obtained by all polymerisation techniques well known to a person skilled in the art (solution polymerisation, suspension polymerisation, gel polymerisation, precipitation polymerisation, emulsion polymerisation (aqueous or reverse), microemulsion polymerisation followed or not by a spray drying step, suspension polymerisation, micellar polymerisation followed or not by a precipitation step).

Depending on the selection of monomers and of the various polymerisation additives, the polymer may have a linear, branched, cross-linked structure or may be a comb polymer or star polymer.

The secondary retention aid is introduced into the suspension, most preferably in a proportion of 50 g/t to 800 g/t by weight of active polymer per tonne of dry pulp, preferably 80 g/t to 500 g/t, and more preferably 100 to 350 g/t.

C/ Tertiary Retention Aid

These aids preferably comprise, but without limitation, alone or in a mixture: derivatives of silica such as, for example, silica particles including bentonites derived from hectorites, smectites, montmorillonites, nontronites, saponites, sauconites, hormites, attapulgites and sepiolites, aluminosilicate or borosilicate derivatives, zeolites, kaolinites, or colloidal silicas, modified or not.

This type of tertiary aid is preferably introduced just upstream of the headbox, in a proportion of 300 to 3000 g/t, preferably 800 to 2000 g/t, by dry weight of active matter per tonne of dry pulp.

The tertiary retention aid may also be selected from water-soluble or water-swellable organic polymers having an anionic charge density above 0.1 meq/g, advantageously having an intrinsic viscosity IV above 3 dl/g, the said polymer being different from the polymer used as secondary retention aid. On this assumption, the dosage of the tertiary retention aid is selected in the same range as that of the secondary retention aid, that is to say, in a proportion of 50 g/t to 800 g/t, preferably 80 g/t to 500 g/t, and more preferably 100 to 350 g/t, by weight of active polymer per tonne of dry pulp.

In an advantageous embodiment, a coagulant is added to the fibrous suspension, prior to the addition of the main retention aid.

As the person skilled in the art well knows, the use of this type of product serves to neutralise the anionic colloids which are harmful and impact the performance of the cationic retention aid, in doses (active) of 0.01 to 10 kg/t and preferably between 0.03 and 3 kg/t. Mention can be made in particular, and as examples, of coagulants selected from the group comprising inorganic coagulants such as aluminium polychloride (PAC), aluminium sulphate, aluminium polychlorosulphate, etc., or organic coagulants including polymers based on diallyldimethyl ammonium chloride (DADMAC), quaternary polyamines produced by condensation of a primary or secondary amine on epichlorhydrin or resins of the dicyandiamide type. These coagulants can be used alone or in a mixture and are preferably added to the thick stock.

It should be noted that the addition of secondary and tertiary retention aids can be made in any order of introduction, in a mixture or not.

The following examples illustrate the invention but without limiting its scope.

EXAMPLES

The retention system of the invention provides good performance, particularly in total retention, filler retention, drainage and clarification of white water, and without destroying the formation.

Test procedure for evaluating the total retention and filler retention

The various results were obtained using a Britt Jar, with a stirring rate of 1000 rpm.

The following sequence was used in adding the various retention aids:

T=0 s: Stirring of 500 ml of 0.5% pulp
T=10 s: Addition of main retention aid
T=20 s: Optional addition of tertiary retention aid
T=25 s: Addition of secondary retention aid
T=30 s: Recovery of 100 ml of white water The first pass retention in percentage (% FPR), corresponding to the total retention is calculated by the following formula:

$$\%FPR=(C_{HB}-C_{WW})/C_{HB}*100$$

The first pass ash retention in percentage (% FPAR) is calculated by the following formula:

$$\%FPAR=(A_{HB}-A_{WW})/A_{HB}*100$$

Where:

$C_{HB}$: Headbox consistency
$C_{WW}$: White water consistency
$A_{HB}$: Headbox ash consistency
$A_{WW}$: White water ash consistency Test procedure for evaluating drainage and clarification of white water The various results were obtained using a static sheet former to stir the pulp, with a stirring rate of 1000 rpm.

The following sequence was used to add the various retention aids:

T=0 s: Stirring of 1000 ml of 0.3% pulp
T=10 s: Addition of main retention aid
T=20 s: Optional addition of tertiary retention aid
T=25 s: Addition of secondary retention aid
T=30 s: End of stirring and recovery of the liter of pulp.

A Canadian Standard Freeness (CSF) apparatus is then used according to standard TAPPI T227OM-94 to measure the drainage of the pulp treated by the retention and drainage system.

To evaluate the clarification of water, the corresponding white water is then recovered and the turbidity is measured (NTU) using a Hach 2100N apparatus.

The highest values obtained for %FPR, % FPAR and CSF correspond to the best performance. On the other hand, the lowest turbidities (NTU) correspond to increased clarification of the water.

Test Procedure for Evaluating Formation

A static sheet former is used to fabricate sheets with a pulp that is or is not treated previously with the various retention systems selected, and this sheet is then pressed and dried.

After drying, we visually evaluate the homogeneity of the sheet to determine its comparative formation index within a given series of tests.

The scale of the formation index is defined as follows:

1: Excellent, homogeneous,
2: Good, uniform,
3: Medium, cloudy,
4: Poor, wooly,
5: Disastrous, heterogeneous.

Description of Products:

| Product | Description | IV (dl/g) |
|---|---|---|
| CS | Cationic potato starch sold by Roquettes under the name Hi Cat 5213 A | NA |
| X1 | Poly(dadmac) in liquid form | 0.8 |
| X2 | Poly(amine) in liquid form with molecular weight | 0.6 |
| X3 | Poly(ethylene imine) sold by BASF under the name Polymin SK | 0.65 |
| X4 | Poly(ethylene imine) sold by BASF under the name Polymin HM | 0.55 |
| P0 | High molecular weight cationic 10 mol % polyacrylamide in powder form | 12.9 |
| P1 | Hofmann degradation product (30 cps at 10%) | 0.38 |
| P2 | Hofmann degradation product (300 cps at 10%) | 1.26 |
| S0 | Anionic 30 mol % polyacrylamide in liquid form (2500 cpst at 15%) | 1.6 |
| S1 | 30 mol % polyacrylamide. Anionic in emulsion form | 23.5 |
| S2 | 30 mol % polyacrylamide. Anionic in powder form | 19.8 |
| NP | Colloidal silica sold by EKA under the name NP780 | NA |
| BI | Bentonite sold by Amcol under the name Accoform BI | NA |

A-Analysis of the various retention systems

A-1-Retention Systems not Involving a High Molecular Weight Anionic Polymer as Secondary Aid The following tests were performed on a pulp consisting of a mixture of:

70% white deciduous kraft fibres
10% white resinous kraft fibres
20% mechanical pulp fibres based on pine
30% natural calcium carbonate

| Test | Retention Systems | % FPR | % FPAR | CSF (ml) | NTU |
|---|---|---|---|---|---|
| 1 | White | 65.8 | 1.3 | 380 | 2400 |
| 2 | P0 (250 g/t) | 75.9 | 35.7 | 460 | 97 |
| 3 | P1 (250 g/t) | 68.7 | 12.2 | 392 | 93 |
| 4 | P2 (250 g/t) | 70.1 | 18.7 | 438 | 90 |
| 5 | CS (500 g/t)* P0 (250 g/t) NP (600 g/t) | 77.9 | 44.5 | 516 | 60 |
| 6 | CS (500 g/t)* P1 (250 g/t) NP (600 g/t) | 69.7 | 19.8 | 456 | 60 |
| 7 | CS (500 g/t)* P2 (250 g/t) NP (600 g/t) | 71.1 | 22.0 | 471 | 61 |
| 8 | P0 (250 g/t) BI (1.5 kg/t) | 78.3 | 44.9 | 496 | 86 |
| 9 | P1 (250 g/t) BI (1.5 kg/t) | 70.5 | 20.7 | 435 | 64 |

-continued

| Test | Retention Systems | % FPR | % FPAR | CSF (ml) | NTU |
|---|---|---|---|---|---|
| 10 | P2 (250 g/t)<br>BI (1.5 kg/t) | 72.1 | 23.0 | 452 | 62 |

(*During the use of cationic starch, it was added to the pulp prior to the actual test sequence)

The preceding tests show that the use of a Hofmann degradation product as primary retention aid, in the absence of a high molecular weight anionic secondary retention aid, provides no benefit in terms of retention and drainage performance compared with the use of a conventional high molecular weight retention aid.

A-2-Retention Systems Involving a High Molecular Weight Anionic Polymer as a Secondary Aid The following tests were performed on a pulp consisting of a mixture of:

70% white deciduous kraft fibres
10% white resinous kraft fibres
20% mechanical pulp fibres based on pine
30% natural calcium carbonate

| Test | Retention systems | % FPR | % FPAR | CSF (ml) | NTU |
|---|---|---|---|---|---|
| 1 | White | 65.8 | 1.3 | 380 | 2400 |
| 11 | P0 (250 g/t)<br>S1 (150 g/t) | 78.8 | 45.9 | 463 | 63 |
| 12 | P1 (250 g/t)<br>S1 (150 g/t) | 81.0 | 51.0 | 551 | 21 |
| 13 | P2 (250 g/t)<br>S1 (150 g/t) | 84.2 | 53.9 | 560 | 16 |
| 14 | P0 (250 g/t)<br>S2 (150 g/t) | 78.8 | 43.0 | 455 | 66 |
| 15 | P1 (250 g/t)<br>S2 (150 g/t) | 81.8 | 43.3 | 535 | 24 |
| 16 | P2 (250 g/t)<br>S2 (150 g/t) | 82.4 | 44.8 | 541 | 22 |
| 17 | CS (500 g/t)*<br>P0 (250 g/t)<br>NP (600 g/t)<br>S1 (150 g/t) | 80.5 | 55.5 | 512 | 42 |
| 18 | CS (500 g/t)*<br>P1 (250 g/t)<br>NP (600 g/t)<br>S1 (150 g/t) | 82.5 | 58.3 | 589 | 17 |
| 19 | CS (500 g/t)*<br>P2 (250 g/t)<br>NP (600 g/t)<br>S1 (150 g/t) | 87.7 | 62.3 | 607 | 12 |
| 20 | P0 (250 g/t)<br>BI (1.5 kg/t)<br>S1 (150 g/t) | 81.7 | 56.6 | 493 | 45 |
| 21 | P1 (250 g/t)<br>BI (1.5 kg/t)<br>S1 (150 g/t) | 83.5 | 59.2 | 571 | 20 |
| 22 | P2 (250 g/t)<br>BI (1.5 kg/t)<br>S1 (150 g/t) | 88.9 | 63.4 | 590 | 13 |

(*During the use of cationic starch, it was added to the pulp prior to the actual test sequence)

In these cases, it is found very clearly, both in terms of retention performance, filler retention and drainage, that the use of a Hofmann degradation product on a polyacrylamide base is beneficial compared to the use of a conventional primary retention aid such as a high molecular weight cationic polyacrylamide.

In fact, the gains observed range between 2 and 7 percentage points for total retention and between 0.5 and 8 percentage points for filler retention. This increase in retention enables the paper manufacturer to obtain papers with higher filler contents, and with a less loaded short circuit which guarantees less fouling of the machine and hence a lower frequency of breakages and machine shutdowns.

Similarly, the gains observed in drainage are about 80 to 100 ml, which is significant, since this gain is completely unexpected for a person skilled in the art, for a use of a very low molecular weight product compared to a retention aid conventionally used (P0).

This enables the paper manufacturer to accelerate his machine, and hence to increase productivity. In addition, faster drainage guarantees higher sheet dewatering and hence a reduction of the energy expenditure during the drying step.

We finally confirm the tendency to obtain better clarified white water thanks to the turbidity results (NTU) obtained on the water with the corresponding webs. This represents on the machine a reduction in deposits and less bacterial development (slime) liable to cause machine breakage.

It should also be noted that the performance associated with the retention system of the invention is higher at equivalent dosage (with all the advantages listed above), so that the paper manufacturer can use these products with a real advantage in terms of ease and cost of operation, the main retention aid being in liquid form, and hence not requiring a specific preparation unit, as needed for conventional retention aids of the high molecular weight cationic polyacrylamide type in powder or emulsion form.

B-Effect of Dosage of the Main Retention Aid

The following tests were performed on a pulp of recycled industrial fibres.

| Test | Retention Systems | CSF (ml) | NTU | Formation Index |
|---|---|---|---|---|
| 23 | White | 316 | 252 | 0 |
| 24 | P0 (250 g/t)<br>S1 (150 g/t) | 434 | 22.5 | 3 |
| 25 | P1 (250 g/t)<br>S1 (150 g/t) | 475 | 20.9 | 1 |
| 26 | P2 (250 g/t)<br>S1 (150 g/t) | 500 | 19.2 | 2 |
| 27 | P0 (500 g/t)<br>S1 (150 g/t) | 477 | 16.4 | 5 |
| 28 | P1 (500 g/t)<br>S1 (150 g/t) | 507 | 16.3 | 2 |
| 29 | P2 (500 g/t)<br>S1 (150 g/t) | 529 | 11.9 | 3 |

The results for drainage and clarification performance of water under web, in this table, clearly reveal the advantage of using the Hofmann degradation product as main retention aid, in combination with a high molecular weight anionic, amphoteric or associative polymer, instead of a conventional retention aid of the high molecular weight cationic polyacrylamide type.

In fact, the increased dosage of main retention aid has the effect of improving the white water drainage and clarification performance. It should also be noted that the products of the invention remain more effective than a retention polymer conventionally used.

Furthermore, it is important to mention that an application of a conventional primary retention aid in such dosages (500 g/t) causes overflocculation and hence destruction of the formation of the sheet, making this option unfeasible in the field, and affects the physical properties of the paper.

On the other hand, the primary retention aids of the invention, having low molecular weight, allow their use in such dosages without destruction of sheet formation, consequently serving to obtain retention and drainage levels never hitherto achieved by primary retention aids conventionally used.

C-Comparison of Various Primary Retention Aids

The following tests were performed on a pulp consisting of a mixture of:

70% white deciduous kraft fibres
10% white resinous kraft fibres
20% mechanical pulp fibres based on pine
20% natural calcium carbonate

| Test | Retention systems | % FPR | % FPAR |
|---|---|---|---|
| 30 | White | 67.9 | 1.3 |
| 31 | X1 (250 g/t)<br>BI (1.5 kg/t)<br>S1 (150 g/t) | 80.5 | 51.1 |
| 32 | X2 (250 g/t)<br>BI (1.5 kg/t)<br>S1 (150 g/t) | 81.2 | 53.1 |
| 33 | X3 (250 g/t)<br>BI (1.5 kg/t)<br>S1 (150 g/t) | 85.3 | 64.8 |
| 34 | X4 (250 g/t)<br>BI (1.5 kg/t)<br>S1 (150 g/t) | 86.3 | 67.5 |
| 35 | P0 (250 g/t)<br>BI (1.5 kg/t)<br>S1 (150 kg/t) | 84.7 | 63.5 |
| 36 | P2 (250 g/t)<br>BI (1.5 kg/t)<br>S1 (150 g/t) | 87.7 | 72.4 |

In comparison with the preceding tests, it is observed that in combination with a high molecular weight anionic polymer, the use of a product of the invention as primary retention aid is significantly beneficial in terms of retention and filler retention performance compared to any other primary retention aid.

D-Effect of Dosages and Comparison of Various Secondary Retention Aids

The following tests were performed on a pulp consisting of a mixture of:

70% white deciduous kraft fibres
10% white resinous kraft fibres
20% mechanical pulp fibres based on pine
30% natural calcium carbonate

| Test | Retention systems | % FPR | % FPAR | CSF (ml) |
|---|---|---|---|---|
| 1 | White | 65.8 | 1.3 | 380 |
| 37 | P2 (250 g/t)<br>S0 (150 g/t) | 67.9 | 7.5 | 420 |
| 38 | P2 (250 g/t)<br>S1 (150 g/t) | 84.2 | 53.9 | 560 |
| 39 | P2 (250 g/t)<br>S2 (150 g/t) | 82.4 | 44.8 | 541 |
| 40 | P2 (250 g/t)<br>S0 (1.5 kg/t) | 75.7 | 17.3 | 412 |
| 41 | P2 (1.5 kg/t)<br>S0 (1.5 kg/t) | 82.5 | 44.7 | 421 |

The results obtained in this series of tests show that the use of low molecular weight anionic polymer as secondary retention aid, when combined with a Hofmann degradation product as main retention aid, does not provide total retention and charge retention performance as good as a high molecular weight anionic polymer, and even in very high dosages. Furthermore, the use of low molecular weight anionic polymers as recommended in documents WO2008/107620 and WO2009/013423 negatively affect drainage. It is therefore indispensable to use a high molecular weight secondary retention aid.

Moreover, the concomitant use of high dosages of the Hofmann degradation product and low molecular weight anionic polymer, although it effectively improves total and filler retention, nevertheless has no effect on drainage. The positive effects on total retention and filler retention are equivalent to those of the invention, but in dosages 6 to 10 times greater and hence at commensurately higher costs (test 41 compared to test 39).

What is claimed is:

1. A method for manufacturing at least one of a sheet of paper and a board, comprising, before the formation of the at least one of the sheet and the board, the step of adding at least two retention aids to a fibrous suspension, at one or more injection points, the at least two retention aids comprising:

a main retention aid comprising a (co)polymer having a cationic charge density above 2 meq/g, obtained by the Hofmann degradation reaction, in aqueous solution, in the presence of at least one of an alkaline-earth and alkali hydroxide and of at least one of an alkaline-earth and alkali hypohalide, on a base (co)polymer comprising at least one nonionic monomer selected from the group consisting of acrylarnide, methacrylarnide, N,N dimethylacrylarnide and combinations thereof, and a secondary retention aid comprising a water-soluble or water-swellable polymer having an anionic charge density above 0.1 meq/g, wherein:

the main retention aid has a molecular weight of less than 100,000 g/mol, and is introduced into the fibrous suspension in a proportion of 100 to 800 g/t of dry pulp, the secondary retention aid is introduced into the fibrous suspension in a proportion of 50 to 800 g/t of dry pulp and has an intrinsic viscosity IV above 3 dl/g, the main retention aid is introduced into a thin stock in a concentration not exceeding 2%; and the introduction of the main and secondary retention aids is separated by a shear step.

2. The method as claimed in claim 1, wherein the main retention aid is introduced into the fibrous suspension in a proportion of 200 to 500 g/t of dry pulp.

3. The method according to claim 1, wherein the secondary retention aid is introduced into the fibrous suspension in a proportion of 80 to 500 g/t of dry pulp.

4. The method according to claim wherein the retention aid has a cationic charge density above 4 meq/g.

5. The method according to claim 1, wherein the secondary retention aid consists of:

at least one anionic monomer having a carboxyl function, or possessing a sulphonic acid function or possessing phosphonic functions.

6. The method according to claim 1, wherein the at least two retention aids further comprises a tertiary retention aid added to the fibrous suspension, the tertiary retention aid being selected from the group consisting of bentonites derived from hectorites, smectites, montmorillonites, nontronites, saponites, sauconites, hormites, attapulgites arid sepiolites, aluminosilicate or borosilicate derivatives, zeolites, kaolinites, or colloidal silicas, modified or not.

7. The method according to claim 6, wherein the tertiary retention aid is introduced in a proportion of 300 to 3000 g/t by weight of active matter per tonne of dry pulp.

8. The method according to claim 7, wherein the tertiary retention aid is introduced in a proportion of 800 to 2000 g/t by weight of active matter per tonne of dry pulp.

9. The method according to claim 1, wherein the at least two retention aids further comprises a tertiary retention aid added to the fibrous suspension, the tertiary retention aid comprising water-soluble or water-swellable organic polymers having an anionic charge density above 0.1 meq/g, the polymers comprising the tertiary retention aid being different from the polymers comprising the secondary retention aid.

10. The method according to claim 9, wherein the polymers comprising the tertiary retention aid have an intrinsic viscosity IV above 3 dl/g.

11. The method according to claim 9, wherein the tertiary retention aid is introduced in a proportion of 50 g/t to 800 g/t by weight of active polymer per tonne of dry pulp.

12. The method according to claim 11, wherein the tertiary retention aid is introduced in a proportion of 80 g/t to 500 g/t by weight of active polymer per tonne of dry pulp.

13. The method according to claim 12, wherein the tertiary retention aid is introduced in a proportion of 100 g/t to 350 g/t by weight of active polymer per tonne of dry pulp.

14. The method according to claim 3, wherein the secondary retention aid is introduced into the fibrous suspension in a proportion between 100 and 350 g/t of dry pulp.

15. The method according to claim 1, wherein the secondary retention aid consists of:

a. at least one anionic monomer having a carboxyl function, or possessing a sulphonic acid function or possessing phosphonic functions, b. one or more nonionic monomers selected from the group consisting of acrylamide, methacrylarnide, N,N dimethylacrylamide, N-vinyl pyrrolidone, N-vinyl acetamide, N-vinyl formamide, vinylacetate, acrylate esters, aHyl alcohol, and combinations thereof, c. one or more cationic monomers selected from the group consisting of quaternized or salified dimethylaminoethyl acrylate (ADAME), quatemized or salified dimethylaminoethyl methacrylate (MADAME), dimethyldiallylammonium chloride (DADMAC), acrylamido propyltrimethyl ammonium chloride (APTAC), methacrylamido propyltrimethyl ammonium chloride (MAPTAC), and combinations thereof, and d. one or more hydrophobic monomers selected from the group consisting of N-tertbutylacrylamide, octylacrylamide, N,N-dihexylacrylamide, alkyl acrylates, methacrylates, and combinations thereof.

* * * * *